US007238869B1

(12) United States Patent
Kleckzka

(10) Patent No.: US 7,238,869 B1
(45) Date of Patent: Jul. 3, 2007

(54) MULTI-FUNCTION PLECTRUM

(76) Inventor: David H. Kleckzka, 12605 W. Weatherstone Ct., New Berlin, WI (US) 53151

( * ) Notice: Subject to any disclaimer, the term of this patent is extended or adjusted under 35 U.S.C. 154(b) by 0 days.

(21) Appl. No.: 11/433,536

(22) Filed: May 12, 2006

(51) Int. Cl.
*G10D 3/16* (2006.01)

(52) U.S. Cl. ..... 84/322; 84/320

(58) Field of Classification Search ..... 84/320, 84/322

See application file for complete search history.

(56) References Cited

U.S. PATENT DOCUMENTS

| | | | | | |
|---|---|---|---|---|---|
| 555,599 | A * | 3/1896 | Essig | 84/322 |
| 655,959 | A * | 8/1900 | Cochrane | 84/322 |
| 998,440 | A * | 7/1911 | Willate | 84/322 |
| 2,170,179 | A * | 8/1939 | Wolcott | 84/322 |
| 2,459,274 | A * | 1/1949 | Galetzky | 84/320 |
| 2,484,820 | A * | 10/1949 | Galetzky | 84/322 |
| 3,319,505 | A | 5/1967 | Galetzky | 84/322 |
| D215,029 | S * | 8/1969 | Willat | D17/20 |
| 4,253,372 | A * | 3/1981 | Filipetti | 84/322 |
| D260,529 | S * | 9/1981 | Pearse | D17/20 |
| D290,467 | S * | 6/1987 | Hyduck | D17/20 |
| D292,413 | S * | 10/1987 | Slusser | D17/20 |
| 4,711,150 | A * | 12/1987 | Hyduck | 84/322 |
| D330,905 | S * | 11/1992 | Thomas | D17/20 |
| 5,194,680 | A * | 3/1993 | Reineck | 84/320 |
| 5,419,228 | A * | 5/1995 | Garrett et al. | 84/322 |
| 5,610,349 | A * | 3/1997 | Fogarty et al. | 84/322 |
| 5,894,097 | A * | 4/1999 | Barry | 84/322 |
| 6,130,374 | A * | 10/2000 | Polidori | 84/322 |
| 6,335,477 | B1 * | 1/2002 | Miller | 84/322 |
| 7,067,729 | B2 * | 6/2006 | Leong | 84/322 |
| 2005/0109189 | A1 * | 5/2005 | Judd | 84/322 |

OTHER PUBLICATIONS

D'Andrea 390 Sharkfin Guitar Picks, on sale and www.musiciansfriend.com.*

Merry, Graham, Plectra/Plectrums, posted Apr. 11, 2004, http://www.guitarnoise.com/article.php?id=444.*

Diplectrum, Halfbakery, http://www.halfbakery.com/idea/Diplectrum, citation from 2004 and 2005.*

* cited by examiner

*Primary Examiner*—Lincoln Donovan
*Assistant Examiner*—Robert W. Horn
(74) *Attorney, Agent, or Firm*—Donald J. Ersler

(57) ABSTRACT

A multi-function plectrum includes a substantially triangularly shaped body. The body includes a first leg, a second leg and a third leg. The first leg includes a rounded edge. The second leg includes a rounded edge. One end of the first leg is joined to one end of the second leg. A picking projection extends from the other end of the second leg. The picking projection comes to a substantial point and tapers gradually to meet a thickness of the body. A taping projection extends from the other end of the second and third legs. Material is removed from substantially a middle of the body on at least one side to create a cavity for a finger or thumb. The body is fabricated from a non-flexible material, such as glass, porcelain, stone, granite resin composite, a gemstone, steel, synthetic polymer resin or any other suitable material.

15 Claims, 1 Drawing Sheet

MULTI-FUNCTION PLECTRUM

BACKGROUND OF THE INVENTION

1. Field of the Invention

The present invention relates generally to guitar picks and more specifically to a multi-function plectrum, which is used to produce unique sounds from a guitar, not possible in prior art picks.

2. Discussion of the Prior Art

U.S. Pat. No. 2,170,179 to Wolcott discloses a pick or plectrum. The Wolcott patent includes a pick that will practically eliminate noise occasioned by contact of the usual pick with strings and will enhance tone and quality of the music produced by stringed instruments. The pick is fabricated from rubber or a rubber composition, which is flexible and yieldable, although relative stiff. U.S. Pat. No. 3,319,505 to Galetzky discloses picks for musical instruments with improved grip including with improved tone. The Galetzky includes a pick with better grip between the fingers and second by means that will increase vibration or resonance of the strings of the instrument and will reduce damping.

U.S. Pat. No. 5,419,228 to Garrett et al. discloses a musical instrument pick with multiple playing surfaces. The Garrett patent includes a musical instrument pick including a metal bar extending along the top of a conventionally shaped pick body. At one end of the metal bar, there is a rounded bevelled end, which is used by holding the pick upside down at an angle 45 degrees. The bevelled end is used to perform arpeggio sweeps. At the opposite end of the metal bar, a tapered surface terminating in a point is provided for fast picking.

Accordingly, there is a clearly felt need in the art for a multi-function plectrum, which allows playing normal up and down stroke picking; arpeggio sweep picking from fretted notes or notes played where the pick hits the string; DJ scratch sounds; picking-hand slide techniques; octaves; chords; sweeps plus trills; glissandos; fast tapping-hammer ons and easy to generate harmonics or any combination of the above. Further, the multi-function plectrum also provides the user with the ability to create unique e and distinguishable sounds, because of the mass, weight, and shape thereof with a distinguishable sound.

SUMMARY OF THE INVENTION

The present invention provides a multi-function plectrum, which includes a combination of extraordinary mass, size, thickness, density and shape to produce unique sounds from a guitar. The multi-function plectrum includes a substantially triangularly shaped body. The body includes a first leg, a second leg and a third leg. The first leg includes a rounded edge. The second leg includes a rounded edge. One end of the first leg is joined to one end of the second leg. A picking projection extends from the other end of the second leg and one end of the third leg. The picking projection comes to a substantial point and tapers gradually to meet a thickness of the body. A taping projection extends from the other end of the second and third legs. The taping projection has a greater thickness than the largest steel string of a typical solid body electrical guitar.

The greatest thickness of the body is at least 7–10 times thicker than a typical medium thickness plastic guitar pick. The mass of the body is 35–45 times greater than the typical medium thickness plastic guitar pick. Material is removed from substantially a middle of the body on at least one side to create a cavity for a finger or thumb. The body is fabricated from a non-flexible material, such as glass, porcelain, stone, granite resin composite, a gemstone, steel, synthetic polymer resin or any other suitable material.

Accordingly, it is an object of the present invention to provide a multi-function plectrum, which allows playing normal up and down stroke picking.

It is an object of the present invention to provide a multi-function plectrum, which allows playing arpeggio sweep picking from fretted notes or notes played where the pick hits the string.

It is another object of the present invention to provide a multi-function plectrum, which allows playing DJ scratch sounds, picking-hand slide techniques, octaves, chords, sweeps plus trills and glissandos.

It is a further object of the present invention to provide a multi-function plectrum, which allows playing fast tapping-hammer ons and easy to generate harmonics.

Finally, it is another object of the present invention to provide a multi-function plectrum, which allows the user with the ability to create unique and distinguishable sounds, because of the mass, weight, and shape thereof with a distinguishable sound.

These and additional objects, advantages, features and benefits of the present invention will become apparent from the following specification.

DETAILED DESCRIPTION OF THE PREFERRED EMBODIMENTS

Figure 1:
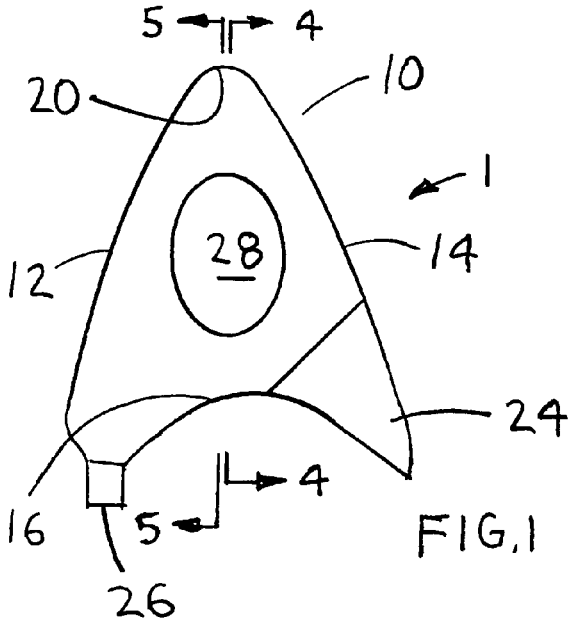
FIG. 1 is a front view of a multi-function plectrum in accordance with the present invention.
Figure 4:
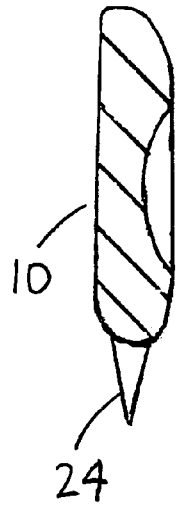
FIG. 4 is a first cross-sectional view of a multi-function plectrum in accordance with the present invention.
Figure 2:
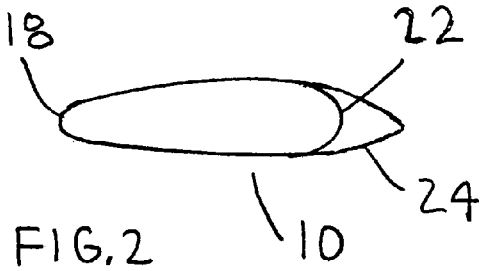
FIG. 2 is a top view of a multi-function plectrum in accordance with the present invention.
Figure 3:
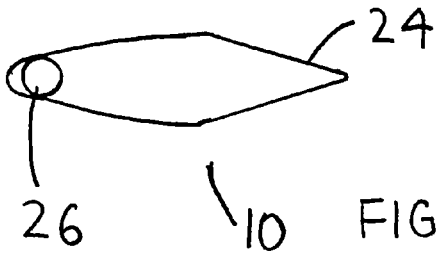
FIG. 3 is a bottom view of a multi-function plectrum in accordance with the present invention.
Figure 5:
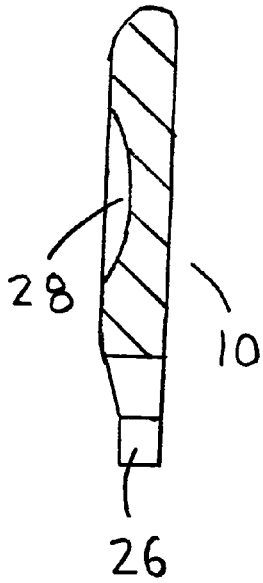
FIG. 5 is a second cross-sectional view of a multi-function plectrum in accordance with the present invention.

With reference now to the drawings, and particularly to FIG. 1, there is shown a front view of a multi-function plectrum 1. With reference to FIGS. 2–5, the multi-function plectrum 1 includes a substantially triangularly shaped body 10. The body 10 includes a first leg 12, a second leg 14 and a third leg 16. The first leg includes a rounded edge 18. One end of the first leg 12 is joined to one end of the second leg 14 with a rounded edge 20 A rounded edge 22 is formed on an outer perimeter of the second leg 14 along a length thereof. The length of the second leg 14 includes a slight outward curvature. The rounded edge 22 may be used as a sweep edge, a slide edge or a glissando edge. A picking projection 24 extends from the other end of the second leg 14 and one end of the third leg 16. The picking projection 24 comes to a substantial point and a thickness of the picking projection gradually tapers to meet a thickness of the body 10.

A taping projection 26 extends from the other end of the third leg 16. A flat surface being formed on an end of the taping projection 26. The third leg 16 includes an inwardly curving length to provide one side of the picking projection 24 at a first end. The inwardly curving length provides clearance for use of the taping projection 26. The taping projection 26 has a greater thickness than the largest steel string of a typical solid body electrical guitar. The taping projection 26 is preferably round in shape, but other shapes may also be used. The taping projection 26 is used for hammering and tapping style techniques.

The following dimensions and relative examples are given by way of example and not by way of limitation. The greatest thickness of the body 10 is at least 7–10 times thicker than a typical medium thickness plastic guitar pick. The thickness dimension of the body is preferably between 0.15–0.30 inches. The taping projection 26 preferably has a diameter of between 0.10–0.16 inches. The mass of the body is 35–45 times greater than the typical medium thickness plastic guitar pick. Material is preferably removed from substantially a middle of the body on at least one side to create a cavity 28 for a finger or thumb. The multi-function plectrum 1 is fabricated from a non-flexible material, such as glass, porcelain, stone, granite resin composite, a gemstone, steel, synthetic polymer resin or any other suitable material.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A multi-functional plectrum comprising:

a body having a first leg, a second leg and a third leg, one end of said first leg is joined to one end of said second leg, one end of said third leg is terminated by the other end of said second leg, the other end of said third leg is terminated by the other end of said first leg;

a picking projection being formed on a junction between said second leg and said third leg, a thickness and width of said picking projection converging from a maximum thickness of said body to a sharply pointed picking portion;

said third leg having an inwardly curving length;

said second leg having a slight outward curvature.

The special features are the details regarding picking projection.

2. The multi-function plectrum of claim 1, further comprising:

a tapping projection extending from said third leg, a flat surface being formed on an end of said tapping projection.

3. The multi-function plectrum of claim 1 wherein:

said body having a thickness of at least 0.15 inches.

4. The multi-function plectrum of claim 1 wherein:

said body being fabricated from a non-flexible material.

5. The multi-function plectrum of claim 1 wherein:

a rounded edge being formed on an outer perimeter of said second leg along a length thereof.

6. The multi-function plectrum of claim 1 wherein:

a rounded edge being formed on an outer perimeter of said second leg along a length thereof.

7. The multi-function plectrum of claim 1 wherein:

said second leg having a slight outward curvature.

8. A multi-function plectrum comprising:

a body having a first leg, a second leg and a third leg, one end of said first leg is joined to one end of said second leg, one end of said third leg is terminated by the other end of said second leg, the other end of said third leg is terminated by the other end of said first leg;

a tapping projection extending outward from a perimeter of said third leg, said tapping projection having a length that is at least as long as a width thereof, a string contacting end of said tapping projection being substantially flat.

The special features are the extra length and flat shape of the tapping projection.

9. The multi-function plectrum of claim 8, further comprising:

said body having a thickness of at least 0.15 inches.

10. The multi-function plectrum of claim 8 wherein:

said third leg having an inwardly curving length.

11. The multi-function plectrum of claim 8 wherein:

said body being fabricated from a non-flexible material.

12. A multi-function plectrum comprising:

a body having a first leg, a second leg and a third leg, one end of said first leg is joined to one end of said second leg, one end of said third leg is terminated by the other end of said second leg, the other end of said third leg is terminated by the other end of said first leg;

a picking projection being formed on a junction between said second leg and said third leg, a thickness and width of said picking projection converging from a maximum thickness of said body to a sharply pointed picking portion; and a tapping projection extending outward from a perimeter of said third leg, said tapping projection having a length that is at least as long as a width thereof, a string contacting end of said tapping projection being substantially flat.

13. The multi-function plectrum of claim 12 wherein:

said third leg having an inwardly curving length.

14. The multi-function plectrum of claim 12 wherein:

a rounded edge being formed on an outer perimeter of said second leg along a length thereof.

15. The multi-function plectrum of claim 12 wherein:

said second leg having a slight outward curvature.

* * * * *